United States Patent [19]

De Lima Castro Netto

[11] Patent Number: 4,818,002

[45] Date of Patent: Apr. 4, 1989

[54] SEALING SYSTEM AND A SEALED SYSTEM

[76] Inventor: Eduardo De Lima Castro Netto, Rua Othon Bezerra de Melo 40, Rio de Janeiro, Brazil

[21] Appl. No.: 936,307

[22] Filed: Dec. 1, 1986

[30] Foreign Application Priority Data

Dec. 20, 1985 [BR] Brazil ..... PI8506415

[51] Int. Cl.[4] ..... B65D 33/34

[52] U.S. Cl. ..... 292/307 R; 292/320

[58] Field of Search ..... 292/307 R, 318, 319, 292/320, 321, 322, 307 A, 307 B, 315, 317; 24/16 PB, 30.5 R, 30.5 P, 20 TT, 206 A

[56] References Cited

U.S. PATENT DOCUMENTS

| | | | |
|---|---|---|---|
| 617,426 | 1/1899 | Roberg | 292/317 |
| 1,174,306 | 3/1916 | Braaten | 292/322 |
| 1,950,803 | 3/1934 | Lewis | 292/307 |
| 3,106,028 | 10/1963 | Baumgartner | 24/16 PB X |
| 3,367,701 | 2/1968 | Wenk, Jr. | 292/321 |
| 3,556,575 | 1/1971 | Farkas | 292/307 R |
| 3,842,688 | 10/1974 | Baginski | 24/16 PB X |
| 4,106,801 | 8/1978 | Neto | 292/307 R |
| 4,175,782 | 11/1979 | Neto | 292/307 R |
| 4,299,417 | 11/1981 | McClure | 292/320 |
| 4,389,754 | 6/1983 | Sohma | 24/16 PB |
| 4,501,049 | 2/1985 | Adamson | 292/318 X |
| 4,537,432 | 8/1985 | Meeks | 292/318 |

FOREIGN PATENT DOCUMENTS

| | | | |
|---|---|---|---|
| 760094 | 12/1933 | France | 292/320 |
| 2051942 | 1/1981 | United Kingdom | 292/307 R |
| 2163707 | 3/1986 | United Kingdom | 292/318 |

*Primary Examiner*—Richard E. Moore

*Attorney, Agent, or Firm*—Beveridge, DeGrandi & Weilacher

[57] ABSTRACT

A high security sealing system is described wherein a single-piece security seal has a lock introduced in a cavity through two openings formed respectively in two elements to be sealed. In order to prevent that a predeformation allows an apparent closing of the system, whereby a violation could take place, the invention proposes the formation of a deflecting member (18, 18') inside the cavity (9), so that, when the lock (26) of the seal (13) is introduced, the lock is inclined with respect to the axis of the openings (12, 21), whereby its locking arms become fastened not only laterally with respect to the inner opening (21) of the two openings, but also above or below them.

2 Claims, 2 Drawing Sheets

II
II
1
2
3
4
5
6
7
8
9
10
11
12
13
14
15
15
17
18
19
20
21
22
23
24
25
26
27
28
29
30

FIG. 2
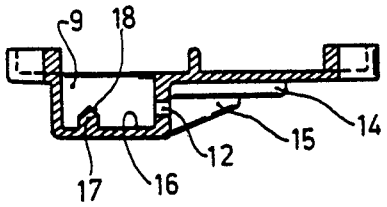
FIG. 4
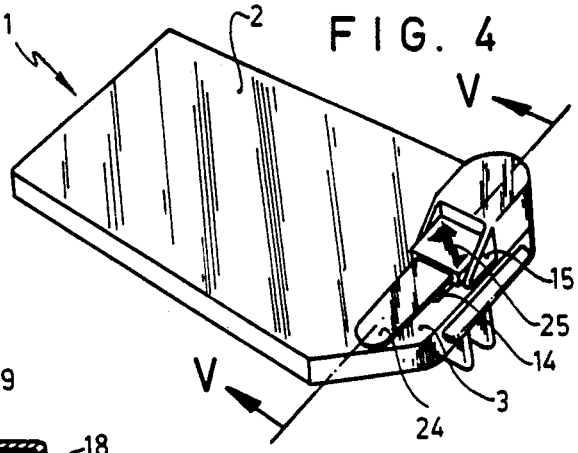
FIG. 6
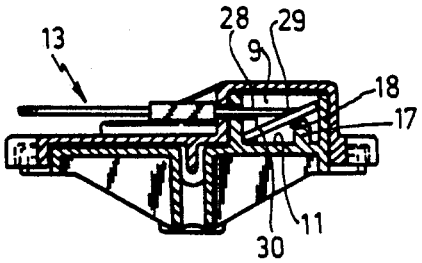
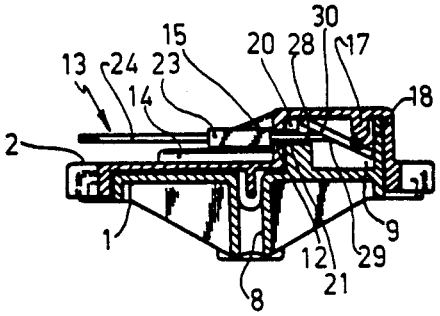
FIG. 5

SEALING SYSTEM AND A SEALED SYSTEM

Systems for sealing two elements to each other are already known from U.S. Pat. Nos. 4106801 and 4175782 respectively, in which the first element has a first part formed with a first opening and the second element has a second part formed with a second opening, such parts being placed adjacent to each other with the openings aligned in the sealing or closed position of the two elements. In this position, the two elements form therebetween a closed cavity behind the second opening on the side of the second part spaced from the first part, said cavity being accessible from the outside only through the openings. The cross section of the cavity is larger than that of the second opening, at least in the region of the latter, so that there is an abutment surface at least at two opposite edges of the second opening.

Sealing systems of this type can be sealed by applying a disposable single-piece security seal of the type illustrated in the above mentioned U.S. Pat. Nos. 4106801 and 4175782 or else of the type shown in Brazilian Patent No. PI 7904129. Basically, these single-piece security seals comprise an elastically deformable lock fixed by means of a weakened region to a second portion that can be removed by breaking the weakened part. When a security seal of this kind is applied to the sealing system mentioned above, the lock is forced through the aligned openings, which causes the elastic compression of same. After passing the openings, the lock expands and becomes caught behind the opposite inner edges of the second opening, which prevents withdrawal thereof, while the disposable portion projects out of the cavity. To open the system, one pulls the disposable portion to break the weakened portion, which allows the removal of the disposable portion and the opening of the two elements of the sealing system. The already separated lock remains inside the cavity, from which it can be removed once the system is open.

Although the assembly described above has been very successful and offers great security , a possibility has been found of opening it "without violation" (that is, without breaking the seal), when the employee responsible for closing the device also participates in a later attempt to violate it. In this case, before applying the seal, the employee pre-compresses the lock so as to bring about a semiplastic deformation. This allows the application of the seal in an "apparent" closing in the sense that the lock does not return elastically to its normal shape and thus does not become properly caught behind the opposite inner edges of the second opening in the system being sealed. As a result, the system seems to be sealed, but actually, it is not, which can be overlooked in a not very careful check. Then, at the time of violating the system, it will be relatively easy to manipulate the seal, so that it comes out of the openings without breaking, thus allowing a "violation" of the system and a later replacement of the seal without leaving any sign of violation.

It is, therefore, an object of the present invention to prevent such non-apparent violations, using the same type of sealing system with a single-piece security seal (similar to that described in Brazilian Patent No. PI 7904129), wherein the elastic deformation of the lock, which is necessary for it to pass through the two openings, occurs in one plane, while the weakened region of the seal in the sealed position is positioned further into the cavity than the points at which the lock becomes caught, usually on two opposite edges of the second opening.

According to the invention, one of the said elements of the sealing system is provided with a deflecting member within the cavity in the sealing position, that has a deflecting surface spaced from the two openings and inclined with respect to the direction of alignment thereof. The cross section of the cavity in the region of the second opening is larger than that of the alignment, at least in the direction opposite that of deflection of the deflecting member, as well as laterally with respect thereto.

With the use of this improved sealing system together with the seal of the type described in patent PI 7904129, when the lock is introduced into the cavity, besides the compression in one plane thereof followed by its expansion after passing through the openings, the front part or nose of the seal abuts the deflecting member, which tilts the lock about the weakened region and keeps it tilted with respect to the compression—expansion plane. In this way, the lock becomes caught in the cavity, not only at the opposite edges of the second cavity, in the compression—expansion plane, but also at one of the other edges (in the direction contrary to the deflection of the nose of the seal). If an attempt of the above-mentioned type is then made to remove the lock from the cavity, it will always be caught at the said other edge of the second opening (or another surface provided for this purpose). Furthermore, the more one tries to remove the seal, the more the lock will be tilted, until the weakened region breaks.

The sealing system of this invention will be better understood from the following description, given by way of example, with reference to the accompanying drawings, in which:

FIG. 2 is a cross-sectional view of FIG. 1 along line II—II;

FIG. 4 is a perspective view of the same bag-closing device in the sealed position;

FIG. 5 is a cross-sectional view of FIG. 4 taken along the lines V—V of FIG. 4; and FIG. 6 is a cross-sectional view similar to FIG. 5, but of a second embodiment of the invention.

Figures 1, 3:
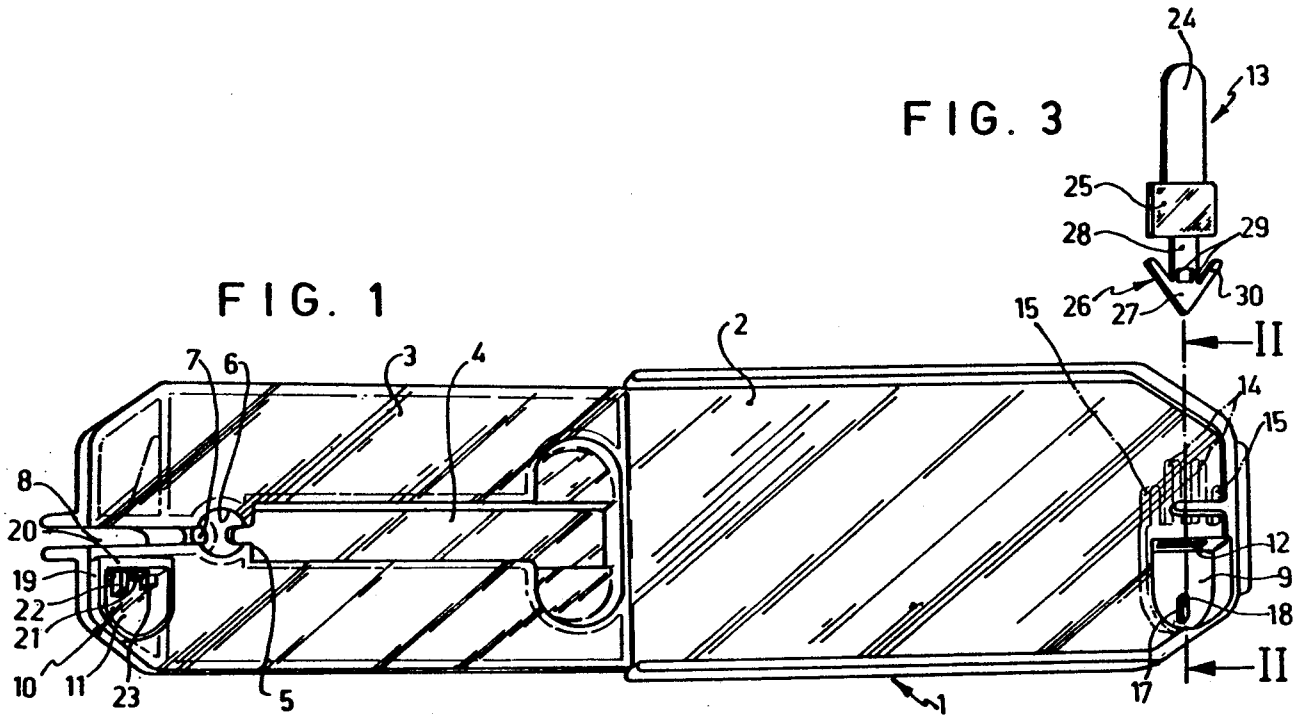
FIG. 1 is perspective view of a preferred embodiment of the present invention, in the form of a bag-closing device in its open position.
FIG. 3 is a plan view of a single-piece security seal appropriate for sealing the device shown in FIGS. 1 and 2.

With reference now to FIGS. 1 to 5 of the drawings, the device for closing the bag 1 illustrated therein is, for almost all purposes, identical to that illustrated in U.S. Pat. No. 4175782, incorporated herein by way of reference, only what is necessary for the understanding of the present invention will now be described.

The device 1 comprises a label-holder in the form of two transparent halves 2 and 3 of plastic material hinged to each other so that, when in the closed or folded position shown in FIG. 4, half 2 will overlap half 3 with a label caught but visible therebetween.

Half 3 is further formed with an elongated cavity 4 to receive a lever of plastics material (not shown) which, although not fixed, pivots about the end 5 of cavity 4. A piece of nylon cord (not shown) has a knot at one end, which is fastened in a little cavity 6 in half 3, the remaining part of the cord passing through an orifice 7 in the bottom of cavity 6. The other end of the cord is fixed at a point along the lever which, in use, is passed around the neck of a bag before one end thereof is inserted into the elongated cavity 4 in half 3 of the device 1, the cord fitting into the slot 8 formed at the free end of half 3. The lever is then pivoted about the end of the elongated cavity 4 until it lies in the latter, thus tightening the cord by means of the lever action around the neck of the bag. After this, half 2 of device 1 is folded over half 3 so as to assume the closed position of the device. All this is clearly described and illustrated in said U.S. Pat. No. 4175782.

For the purposes of the present description, the elements to be sealed with respect to each other are the halves 2 and 3 of the device 1. The sealing system in itself is defined by formations molded as integral parts of the device and comprises an open-bottom cavity 9 in half 2, which cooperates with the formation 10 in half 3, which in the closed position of FIGS. 4 and 5 is received in cavity 9, the surface 11 of formation 10 serving as a bottom for the cavity.

FIGS. 1 and 2 show the cavity 9 more clearly, and it will be seen that the latter is formed by an elongated inlet orifice 12 intended for receiving a part of a security seal 13 shown in FIG. 3. Half 2 of the device 1 is further formed with two small parallel ribs 14, which serve as a support for the seal 13 in the inlet region of orifice 13 and further by two lateral guides 15. The surface 16 of the top of the cavity (its bottom in the position shown in FIGS. 1 and 2) is formed with a deflector or ear 17 provided with a deflecting surface 18 inclined with respect to the axis of orifice or opening 12 and at the same height as the latter. The deflector 17 is one embodiment of the main characteristic of the present invention, and the function thereof will be described below with reference to FIG. 5.

The formation 10 in half 3 of the device 1, which cooperates with the cavity 9, comprises a continuous wall 19 having a straight portion 20 provided with an orifice 21, which corresponds in size to the orifice 12 associated with cavity 9. In the closed position of the device 1, the continuous wall 19 perfectly fits into cavity 9 with the outer surface of wall 19 in contact with the inner side wall of cavity 9 and with orifices 12 and 21 perfectly aligned and adjacent to each other.

There is also a little rib 22 on surface 11, centrally placed with respect to orifice 21 and having a height as high as the lower surface of this orifice (see FIG. 1). This rib 22 also serves as a guide for the security seal 13 (FIG. 3). Besides, there are two little protuberances (only one is seen in FIG. 1) at the same height as rib 22 and arranged at the side ends of orifice 21.

Considering now FIG. 3, the security seal 13 comprises a blade 24, an enlarged portion 25 having a cross section a little larger than that of orifices 12 and 21, and an arrow-shaped lock 26, the head 27 of the arrow being connected to its central shaft 28 by two weakening bridges 29. The head of the arrow has two elastic arms 30.

In the absence of the deflector 18, we have a bag-closing device substantially identical to that illustrated in U.S. Pat. No. 4175782. When the device is closed in the manner mentioned above, the seal 13 is applied as indicated in FIGS. 1 and 3 to obtain the configuration illustrated in FIG. 4.

Thus one grasps the seal by the blade 24 and the lock 26 of the seal is forced through the aligned orifices 12 and 21, whereby the arms 30 are bent inwardly to allow passage thereof through the orifices. After this they expand again so the ends of arms 30 become laterally caught behind the inner surface of portion 20 of wall 19, above protuberances 23. The device 1 is then sealed.

As mentioned before, although the system is inviolable when correctly sealed, it has the disadvantage that it might be opened "without violation", if it is not correctly closed, that is to say, if the seal is intentionally pressed before its use so that the arms 30 undergo a semiplastic deformation and so will not take their correct form after passing through orifices 12 and 21.

The deflector 17 serves to prevent this possibility, its function being clearly seen in FIG. 5. In this case, according to the invention, when the seal 13 is introduced through orifices 12 and 21, head 26 of the lock abuts the deflecting surface 18 of the deflector 17, whereby the whole head 26 tilts around the weakening bridges 29. Thus, the ends of thy arms 30 will be caught not only laterally with respect to orifice 21, but also in a plane about such orifice. Even if the arms 30 have been pressed in advance as described above, this will be of no avail for the violator since the ends of the arms 30 will remain fastened upon part of the inner surface of portion 20 of wall 19, that is located above orifice 21.

As will be seen from FIG. 5, any attempt to pull the blade or otherwise manipulate the seal for the latter to come out of cavity 9 will result in a counterclockwise rotation (as seen in FIG. 5) about bridges 29, which will lock the seal even more, until the bridges break.

It will be understood that the present invention has been described with respect to a specific embodiment, but that other sealing systems similar to that of U.S. Pat. No. 4175782 could benefit from the presence of a deflector similar to deflector 18, provided that it subjects the seal to a deformation in a place other than that in which the seal would normally undergo deformation when it is applied. Besides, it is more than obvious that the deflector in itself could be formed or positioned in a different way. FIG. 6 shows a simple alternative in which a deflector 17' with a deflecting surface 18' is formed on the surface 11 of the formation 10, instead of being on the lower surface of the top of cavity 9. The only difference is then the elimination of protuberances 23 and the fact that head 27 of lock 26 will undergo a clockwise rather than anti-clockwise rotation.

Other alternatives would be making surface 11 already inclined to serve as deflector; a deflector that starts from the inner surface of continuous wall 19 (FIG. 1) in a position opposite to orifice 21; or any others that could suggest themselves to a person skilled in the art. Therefore, the scope of the present invention should not be limited by the above description, but rather by the definitions encountered in the attached claims.

I claim:

1. A system for sealing two elements to each other, comprising:

a first element and a second element which are relatively movable to and from a sealing position wherein the elements form a closed cavity therebetween, said first element having a first opening and said second element having a second opening which are aligned in an alignment direction when the elements are in said sealing position, said closed cavity and said first opening being located on opposite sides of said second opening, one of said elements having a deflecting member which has a deflecting surface means in said closed cavity for deflecting a seal member which is inserted into the closed cavity through said openings; said deflecting surface means being spaced from the openings and being inclined relatively to said alignment direction in order to deflect a seal member in a deflection direction, said cavity in the region of the second opening being larger than the second opening both in a direction which is opposite to said deflection direction and in a direction which is lateral with respect to the deflection direction, a seal which extends through said aligned openings and includes a lock portion located in said closed cavity, said lock portion having a trailing end with an abutment surface which is displaced from said second opening both in a direction which is opposite to said deflection direction and in a direction which is lateral with respect to the deflection direction.

2. A sealing system according to claim 1, characterized by comprising a label holder in which the first and second elements (2, 3) comprise substantially plane parts hinged to each other at one end.

* * * * *